US010822738B2

(12) United States Patent
Chi et al.

(10) Patent No.: US 10,822,738 B2
(45) Date of Patent: Nov. 3, 2020

(54) WASHING MACHINE DOOR HAVING DECORATIVE RING, WASHING MACHINE, AND LAUNDRY METHOD

(71) Applicant: QINGDAO HAIER DRUM WASHING MACHINE CO., LTD., Qingdao (CN)

(72) Inventors: Zongrui Chi, Qingdao (CN); Zhi Chen, Qingdao (CN); Yongchao Chen, Qingdao (CN); Houli Luan, Qingdao (CN); Chao Xu, Qingdao (CN); Huifang Du, Qingdao (CN)

(73) Assignee: QINGDAO HAIER DRUM WASHING MACHINE CO., LTD., Qingdao (CN)

( * ) Notice: Subject to any disclaimer, the term of this patent is extended or adjusted under 35 U.S.C. 154(b) by 119 days.

(21) Appl. No.: 16/090,234

(22) PCT Filed: Mar. 21, 2017

(86) PCT No.: PCT/CN2017/077577
§ 371 (c)(1),
(2) Date: Sep. 29, 2018

(87) PCT Pub. No.: WO2017/167080
PCT Pub. Date: Oct. 5, 2017

(65) Prior Publication Data

US 2019/0112746 A1 Apr. 18, 2019

(30) Foreign Application Priority Data

Mar. 30, 2016 (CN) ..... 2016 1 0193426

(51) Int. Cl.
*D06F 34/28* (2020.01)
*D06F 37/28* (2006.01)
*D06F 39/14* (2006.01)

(52) U.S. Cl.
CPC ..... *D06F 37/28* (2013.01); *D06F 39/14* (2013.01); *D06F 34/28* (2020.02)

(58) Field of Classification Search
CPC ..... D06F 34/28; D06F 37/28; D06F 39/14; D06F 2216/00

(Continued)

(56) References Cited

U.S. PATENT DOCUMENTS

2012/0036900 A1* 2/2012 Hong ..... D06F 34/28 68/139

* cited by examiner

*Primary Examiner* — Levon J Shahinian
(74) *Attorney, Agent, or Firm* — Jiwen Chen; Jacobson Holman PLLC

(57) ABSTRACT

A washing machine door having a decorative ring comprises a time display module (4), a light strip (9), a control device, and a middle frame (5). The time display module (4), the light strip (9) consisting of LED beads, and the control device are installed on the middle frame (5). A mounting area is formed on the middle frame (5) to install therein the time display module (4). Also provided is a decorative ring (3) having a shape matching the middle frame (5). The decorative ring (3) comprises a film layer and a base (3-1). The base (3-1) comprises a time display area (3-1-1) corresponding to the time display module (4), and a remaining area serving as a light display area (3-1-2). The time display area (3-1-1) has transmittance exceeding that of the light display area (3-1-2) of the decorative ring (3). Also provided is a washing machine using the door and a laundry method. When the washing machine powers on, a user can observe the light on the time display module (4) and the light strip (9) without seeding the LED beads. When the washing machine is turned off, the time display module (4) and the light strip (9) are both in a hidden state.

10 Claims, 5 Drawing Sheets

(58) Field of Classification Search
USPC ..... 68/3 R, 13 R, 17 R, 196
See application file for complete search history.

WASHING MACHINE DOOR HAVING DECORATIVE RING, WASHING MACHINE, AND LAUNDRY METHOD

This is a U.S. national stage application of PCT Application No. PCT/CN2017/077577 under 35 U.S.C. 371, filed Mar. 21, 2017 in Chinese, claiming priority of Chinese Application No. 201610193426.2, filed Mar. 30, 2016, all of which are hereby incorporated by reference.

TECHNICAL FIELD

The invention relates to a washing machine and a washing method, in particular to a washing machine door having a decorative ring.

BACKGROUND

Washing machine has been widely used nowadays, and its common types offered in the market comprise front loading washing machine, top loading washing machine, agitating washing machine, dual-power washing machine and the like. In order to meet requirements of users, as well as in response to the development of technology, manufacturers provide more and more washing machine having a door with LED or nixie tubes for displaying information as the time remaining of cycles. Especially in the front loading washing machine, a circle of LED beads is preferably arranged around the observing window of the washing machine door to decorate it. Those modules for displaying time or decorating are only glowing as applying power to; however their inner electrical elements could be seen by the users from the outside as the power off. Those primitive components may disarray the overall design of the washing machine in appearance. According to the users' feedback, they prefer a type of washer with an invisible display module, namely only presenting the visual effects in use. Additionally, the electrical elements of the display module of the prior art does not include any moisture-proof structure, if may further cause the failure of the display module.

The utility model patent ZL201020521460.6 discloses a LED display device of washing machine control panel, which relates to the technical field of washing machine accessories, comprising a control panel, a LED light body and a transparent light-guide plate made of silica gel provided between the control panel and the LED light body. The plate made of silica gel could radiate lights produced by the illuminant, therefore lights produced by the LED point source could be uniformly diverge into an area source on the display region of the control panel and all of the translucent region of the control panel is being illuminated. However, if the power is off, the LED light body still could be seen from the outside which could exert negatively effect on the overall appearance of the washing machine.

The utility model patent CN202116878U discloses a washing device including an operating area on its door where the user could operate to complete the whole washing cycle. The utility model patent ZL200820038373.8 aims to provide a washing machine with time display or a dryer door body, wherein a time display module is mounted on the frame of the door body, which is provided with a transparent observing window. The time display module is configured to be used as a clock or a timer in washing cycle as programmed.

The transparent time display module mounted on the frame is not good at sealing leading to the failure of display, further it could be seen from the outside as the power off which clutters the appearance of the washing machine.

BRIEF SUMMARY

The present invention aims at solving problems of the type of washing machine with the clock display module or the LED light strip to improve its overall appearance and prevent the failure of electrical elements within.

The washing machine door with a decorative ring disclosed by the present invention could enable the time display module and LED lights to be seen as the power supply is on without the appearance of LED beads while turning into invisible as the power supply is off.

In contrast to the above-summarized prior art solutions, one aspect of the disclosure relates to a washing machine door with a decorative ring.

The washing machine door with a decorative ring, comprises a time display module, a light strip, a control device and a middle frame; wherein the time display module, the light strip consisted of LED beads and the control device are arranged on the middle frame; a mounting area is opened at the upper portion of the middle frame and the time display module is arranged within the mounting area; the washing machine door further comprises a decorative ring with a shape matching up with the middle frame, wherein the decorative ring includes one or more layers of film and a base; the base comprises a time display area corresponding to the time display module and a light display area occupying the remaining, the light transmittance of the time display area is greater than that of the light display area; only light could be seen from the light display area without the appearance of LED beads.

The outer surface of the base is provided with concavo-convex patterns in a shape of rhombus, square or diamond.

The base is made of transparent material with an outer film formed on the outer surface by means of vacuum plating or in-mold decoration and a semitransparent inner film formed on the light display area, wherein the thickness of the film on the time display area is less than that of the film on the light display area.

The inner film is formed by means of spraying white paint or diffuse painting ink, or pasting diffuse film on the light display area of the inner surface of the base.

The transparent material made of the base is transparent ABS, transparent PC or transparent acrylic.

Further, the transparent material made of the base is added into a color masterbatch.

Alternatively, the washing machine door with a decorative ring comprises a base made of transparent material and an outer film is formed on the outer surface of the base by means of vacuum plating or in-mold decoration; further comprises a semitransparent light cover arranged between the decorative ring and the middle frame, and the position of the light cover corresponds to the light display area.

Further, the light cover is formed by means of glass atomization or glass frosted, or made of semitransparent plastic with a light transmittance in the range of 30% to 90%.

Alternatively, the washing machine door with a decorative ring comprising a base consisted of a time display area made of transparent material and a light display area made of semitransparent material, wherein the time display area made of transparent material is embedded in the light display area integrally; an outer film is one layer of film formed on the outer surface of the base by means of vacuum plating or in-mold decoration.

A positioning fixing structure is disposed between the decorative ring and the middle frame, and the decorative ring and the middle frame are assembled through the connection of hooks and holes, or by means of melting.

Another aspect of the present invention is to provide a washing machine including the washing machine door with a decorative ring as described above.

Another aspect of the present invention is to provide a laundry method, during which the user could see the time display module and LED light as the power supply is on while could not see the time display module and the light strip as the power supply is off, which comprising:

A. Powering the washing machine and selecting one of the working modes; calculating the overall working time automatically; wherein the time display module and the light strip are being controlled by the control device;

B. Pressing the start button; during the washing process, the overall decorative ring is transparent; in which the time display module displays the remaining working time, and the user also could see LED light, due to the fact that the light transmittance of the light display area is greater than that of the light display area, the LED beads are invisible.

C. Completing the laundry and turning off the power supply, then the decorative ring turns into opaque and the time display module and light strip are invisible.

The improved door of washing machine disclosed by the present invention adds on a decorative ring which manufactured by a designed process to enrich functions of washing machine in the way of displaying or sheltering the remaining working time and the LED lights as need, such that the time display module and LED lights are visible as power on without the appearance of LED beads while being invisible as power off. The time display module and LED beads added do not bring negative effects on the overall appearance of the washing machine. The decorative ring also could enhance the moisture proof effects on the electrical elements including the time display module, the LED beads and the control device.

Figure 1:
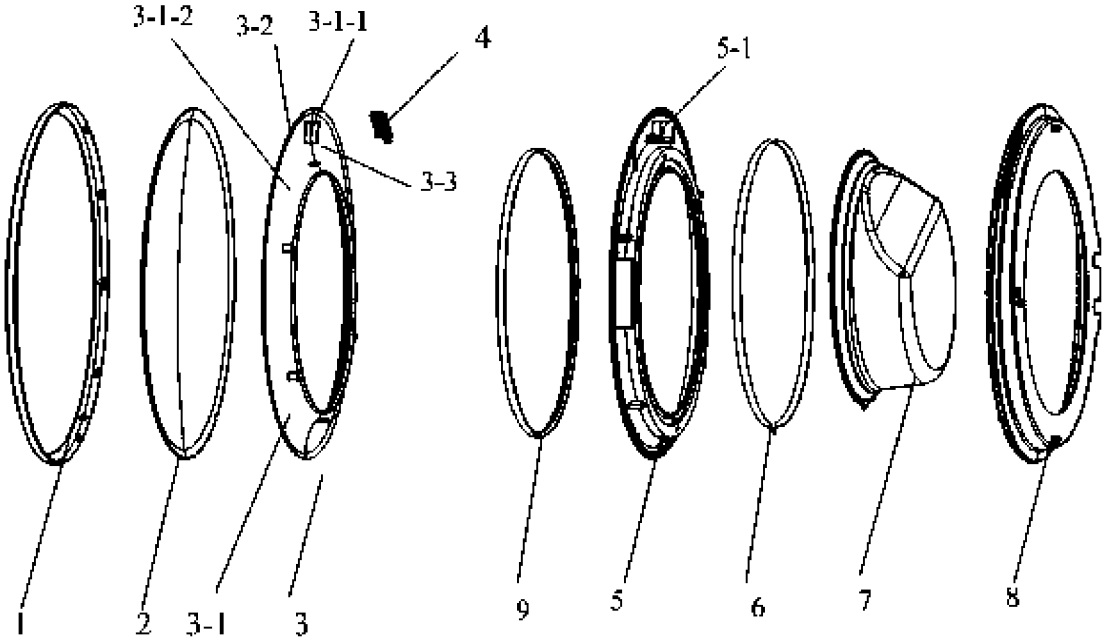
FIG. 1 is an exploded view of an observation window assembly of a washing machine door with a decorative ring according to a first embodiment of the present invention.

in which: outer frame 1, window screen 2, decorative ring 3, base 3-1, outside film 3-2, inner film 3-3; time display area 3-1-1; light display area 3-1-2; hook 3-4; rib 3-5; time display module 4; middle frame 5; mounting area 5-1; groove 5-2; mounting hole 5-3; sealing ring 6; glass 7; inner frame 8; light strip 9; light cover 10; pattern 11.

DETAILED DESCRIPTION

The present disclosure provides a washing machine door having a decorative ring, which will be described in detail with reference to the accompanying drawings.

Embodiment 1

Referring to FIG. 1, a washing machine door having a decorative ring comprises a front panel (not shown in FIG. 1) and an observation window assembly, wherein the observation window assembly comprises an outer frame 1, a window screen 2, a decorative ring 3, a time display module 4, a middle frame 5, a sealing ring 6, a glass 7, an inner frame 8 and a light strip 9 consisted of LED beads, which sequentially arranged from the outside to the inside.

Figure 9:
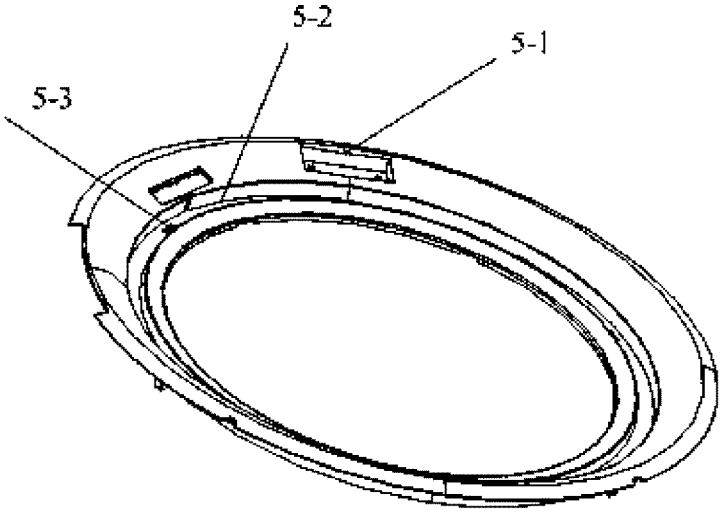
FIG. 9 is a front perspective view of the middle frame.
Figure 10:
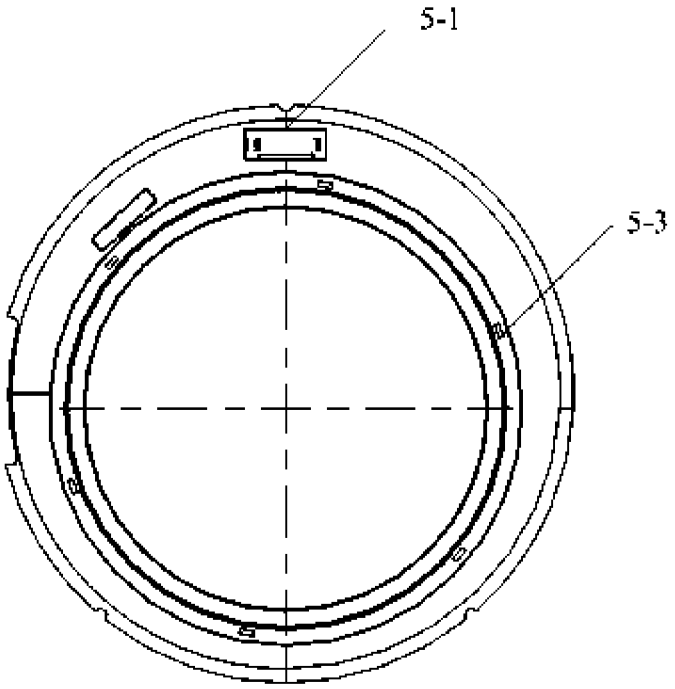
FIG. 10 is a rear perspective view of the middle frame.

Referring to FIG. 9 and FIG. 10, the light strip 9 is mounted in an annular groove 5-2 formed on the middle frame 5. The decorative ring 3 and the middle frame 5 are provided with a positioning fixing structure and assembled through the connection of hooks 3-4 provided on the decorative ring and mounting holes 5-3 opened on the middle frame. As shown in FIG. 1, the glass 7 has a convex surface thereof facing the inside of the washing machine. The observation window assembly is mounted on the middle portion of the front panel to form the door of the washing machine, wherein a mounting area 5-1 for accommodating the time display module 4 is formed in the middle of the upper portion of the middle frame 5. The time display module 4 is embedded in the mounting area 5-1 and a control device is installed in a mounting frame in vicinity of mounting area 5-1.

Figure 6:
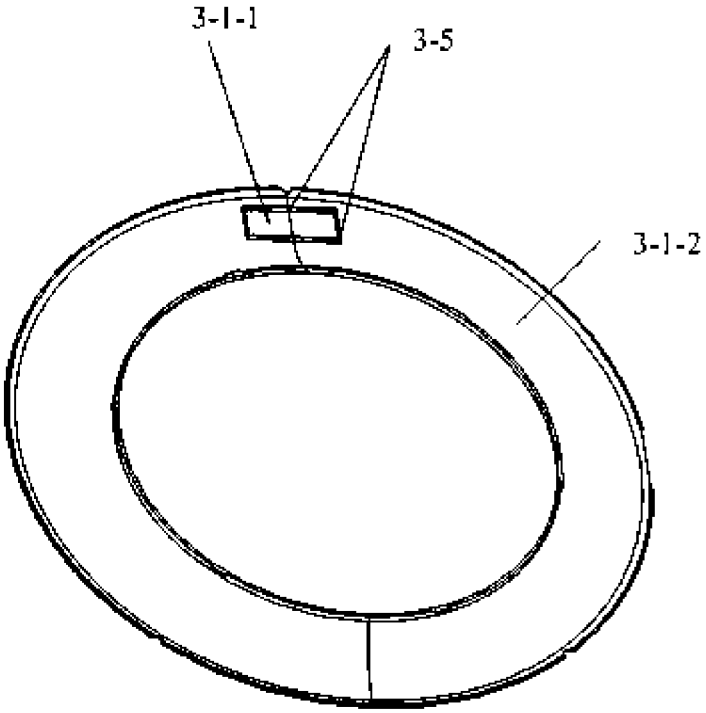
FIG. 6 is a rear perspective view of the decorative ring.
Figure 7:
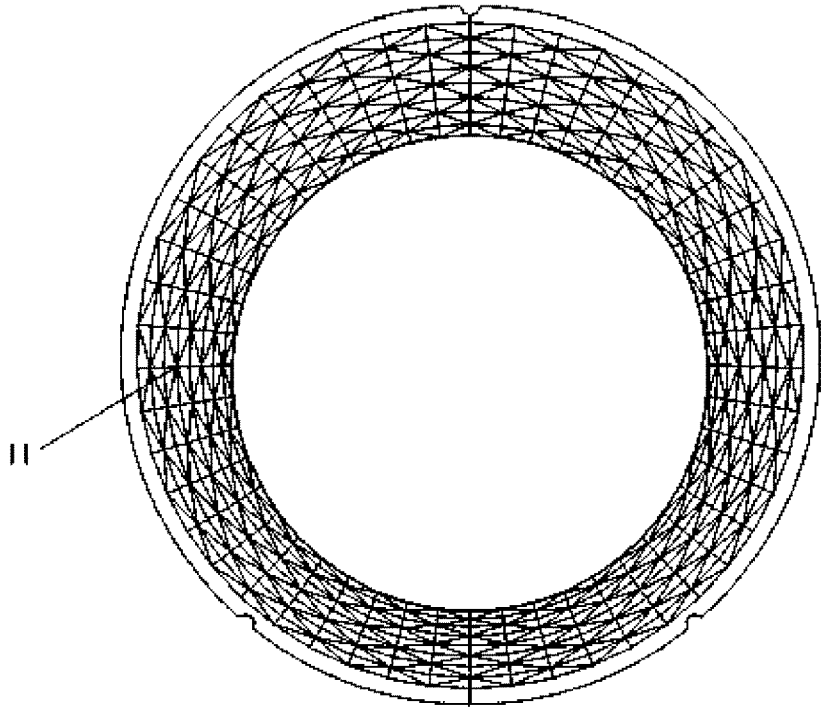
FIG. 7 is a front perspective view of the decorative ring.
Figure 8:
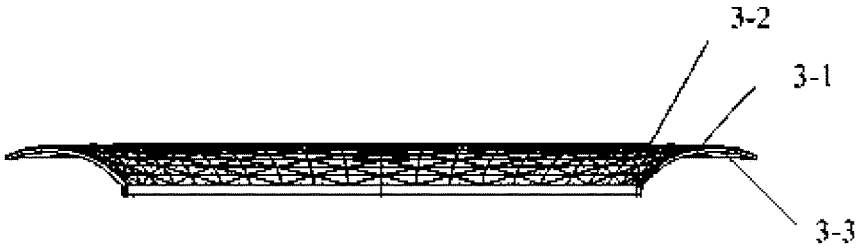
FIG. 8 is a cross-sectional view of the decorative ring.

Referring to FIG. 6 to FIG. 8, the decorative ring 3 is annular and its size matches up with the middle frame 5. The decorative ring 3 comprises a base 3-1, an outside film 3-2 and an inner film 3-3, wherein the base 3-1 is divided into two areas that the one corresponding to the time display module 4 is defined as a time display area 3-1-1 and all of the remaining is defined as a light display area 3-1-2. The periphery of the time display area 3-1-1 is provided with a rib 3-5 configured to separate the time display area 3-1-1 from the light display area 3-1-2.

In the first embodiment, the base 3-1 is made of transparent material, such as transparent ABS, PC or transparent acrylic material. The outer surface of the base 3-1 is provided with concavo-convex patterns in the shape of rhombus, square or diamond and the like.

The outer film 3-2 is formed on the outer surface of the base 3-1 where the patterns on by means of vacuum plating or in-mold decoration. The inner film 3-3 is formed on the inner surface of the base 3-1 by means of spraying white paint, spraying diffuse printing ink or pasting diffuse film. It is particularly noted that the inner film 3-3 is disposed out of the time display area 3-1-1. Practically, the rib 3-5 around the time display area could prevent the time display area 3-1-1 from being sprayed on white paint or paint ink, or being pasting with diffuse film.

The outer film 3-2 could be a thin coherent metal coating on the outer surface of the base 3-1 which formed by electroplating or vacuum plating, wherein the metal coating may be made of one selected from aluminum, aluminum, titanium, zirconium or other metals with lower potential. The formed coating is opaque as the power supply is off. In this embodiment, the base 3 made of transparent material could make the display of the remaining time more clear in washing cycle, the outer film formed by vacuum plating or in-mold decoration on the side where patterns on could prevent the inside primitive elements from being seen as the power supply is off, so as to ensure they could turn into the visible status as the power on. In order to hide the LED beads, the inner film formed by means of spraying white paint, spraying diffuse printing ink or pasting diffuse film on the side where without patterns is provided, it should be noted that no ink or film should be disposed on the time display area.

In order to enrich the color of the door of washing machine, masterbatch is added to the transparent material of the base 3-1 to turn it into brown, dark green and the like.

In this way, the time display module, the control device and LED beads are also protected by the decorative ring from being corroded by moisture, thereby improving the reliability of those electrical elements.

Further, in order to prevent the time display module from being corroding, a U-shaped sealing ring 6 is arranged on the periphery of the glass 7 and the inner side of the sealing ring 6 abuts the inner frame to prevent moisture inside the drum from entering into those electrical elements.

The reference numerals of the decorative ring 1 are understood as follows: the inner film 3-3, the base 3-1 and the outer film 3-2 are sequentially arranged from the inside to the outside; according to the varied electrical elements corresponding to specific areas of the ring, the base 3-1 is divided into a time display area 3-1-1 and a light display area 3-1-2, wherein the overall thickness of the films on the time display area 3-1-1 is smaller than that on the light display area 3-1-2.

Embodiment 2

Figure 2:
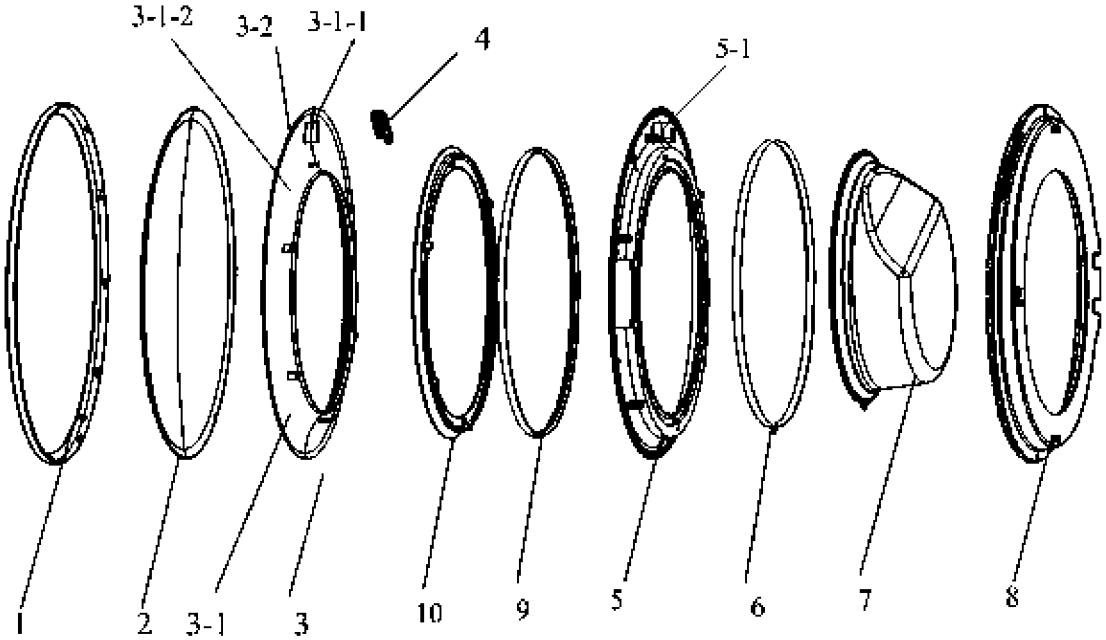
FIG. 2 is an exploded view of an observation window assembly of a washing machine door with a decorative ring according to a second embodiment of the present invention.
Figure 3:
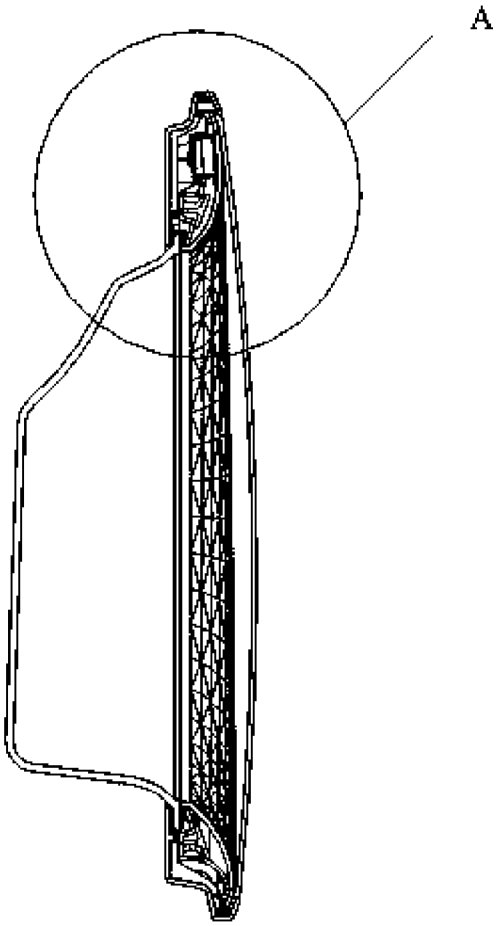
FIG. 3 is a cross-sectional view of the second embodiment.
Figure 4:
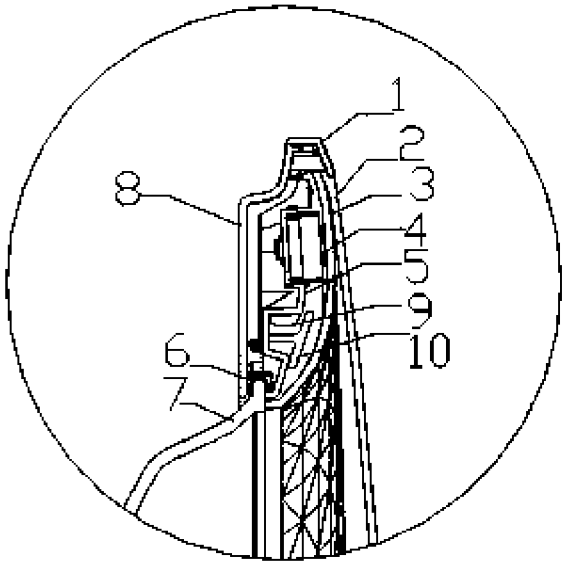
FIG. 4 is a partial enlarged view of FIG. 3.

Referring to FIG. 2 to FIG. 4, an alternative structure of the washing machine door is provided. Compared with the Embodiment 1, the base 3-1 is also made of transparent material, but only one layer of the outer film 3-2 is provided on the outer surface of the base 3-1 by means of vacuum plating or in-mold decoration and the inner film is omitted; a semitransparent light cover 10 is provided between the decorative ring 3 and the middle frame 5. The light cover 10 is formed by means of glass atomization or glass frosted, or semitransparent material with a light transmittance in the range of 30% to 90%. To be specific, the light cover 10 is disposed out of the time display area 3-1-1 to merely shelter the light display area 3-1-2. The light cover 10 and the middle frame 5 are assembled through the connection of hooks and holes, or the connection of positioning columns and positioning holes.

In FIG. 2, the base 3-1 and the outer film 3-2 are sequentially arranged from the inside to the outside; according to the varied electrical elements corresponding to specific areas of the ring, the base 3-1 is divided into a time display area 3-1-1 and a light display area 3-1-2, wherein time display area 3-1-1 is not sheltered by the light cover 10 to make the time displaying clear in washing.

Embodiment 3

Figure 5:
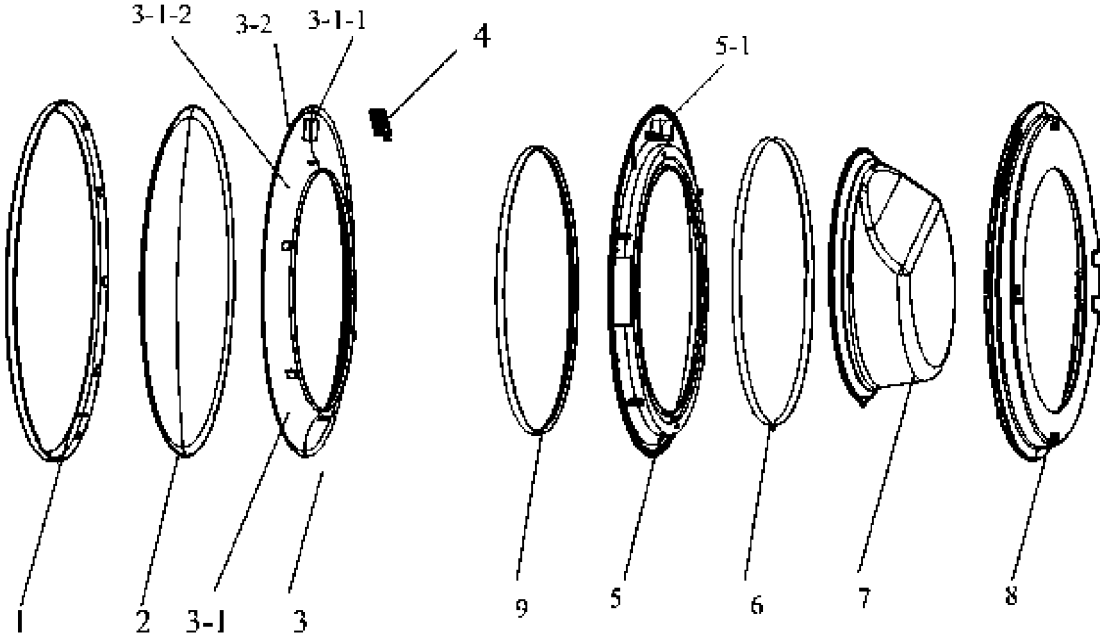
FIG. 5 is an exploded view of an observation window assembly of a washing machine door with a decorative ring according to a third embodiment of the present invention.

Referring to FIG. 5, a washing machine door having a decorative ring comprises a base 3-1 consisted of two independent parts, wherein the time display area 3-1-1 is made of transparent material and the light display area 3-1-2 of the base is made of semitransparent material. The time display area 3-1-1 made of transparent material is an embedded component and molded with the light display area 3-1-2 to form the base 3-1 integrally. Only the outer film is provided by means of vacuum plating or in-mold decoration. The semitransparent material could hide the LED beads as power on.

In FIG. 5, it should be specified that the base 3-1 and the outer film 3-2 are sequentially arranged from the inside to the outside; according to the varied electrical elements corresponding to specific areas of the ring, the base 3-1 is divided into a time display area 3-1-1 and a light display area 3-1-2.

The present invention also relates to a washing machine having the door as described above and a washing method:

in which as power on, the user of washing machine could see the time display module and the LED lights while the LED beads are invisible; as the power supply is off, the user could not see the time display module and the light strip. The washing method comprises:

Powering the washing machine and activating the power button, while maintaining the time display module out of power; during which the time display area is not being illuminated so that the time display module is invisible from the outside.

Selecting working modes of washing machine and calculating the overall working time; activating the start button, enabling the time display module to display the remaining working time; during which the decorative ring is transparent and the light transmittance of the time display area is higher than that of the light display area; the user of washing machine could see LED lights without LED beads; as the washing completed, turning the power supply off; then the decorative ring, including the time display module and the light strip, is invisible.

The improved door of washing machine disclosed by the present invention adds on a decorative ring to enrich functions of washing machine in the way of displaying or sheltering the remaining working time and the LED lights as need, such that the time display module and LED lights are visible as power on without the appearance of LED beads while being invisible as power off. The time display module and LED beads added do not bring negative effects on the overall appearance of the washing machine. The decorative ring also could enhance the moisture proof effects on the electrical elements including the time display module, the LED beads and the control device.

The washing machine and the washing method provided could enable the user to observe the remaining working time in a convenient way, so as to flexibly arrange the next step or collect the rising water for reusing. The visible and invisible statuses of the time display module according to different power statuses could meet diverse users' requirements and enhance the aesthetics of the washing machine.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A washing machine door with a decorative ring comprising:

a middle frame provided with a mounting area on the upper portion;

a time display module arranged within the mounting area of the middle frame;

a light strip consisted of LED beads mounted on the middle frame;

a control device arranged on the middle frame;

wherein the decorative ring matching up with the middle frame comprises:

one or more layers of films; and a base comprising a time display area corresponding to the time display module and a light display area occupying the remaining; wherein the light transmittance of the time display area is greater than the light transmittance of the light display area;

wherein the outer surface of the base is provided with concavo-convex patterns in a shape of rhombus, square or diamond; and wherein the base is made of transparent material; the films comprise an outer film and an inner film, wherein the outer film is formed on the outer surface of the base by means of vacuum plating or in-mold decoration; the semitransparent inner film is formed on the light display area; wherein the thickness of the film on the time display area is less than that of the films on the light display area.

2. The washing machine door with a decorative ring according to claim 1, wherein the inner film is formed by means of spraying white paint or diffuse painting ink, or pasting diffuse film on the light display area of the inner surface of the base.

3. The washing machine door with a decorative ring according to claim 1, wherein the transparent material made of the base is transparent ABS, transparent PC or transparent acrylic.

4. The washing machine door with a decorative ring according to claim 3, wherein the transparent material made of the base is added into a color masterbatch.

5. The washing machine door with a decorative ring according to claim 1, wherein the base is made of transparent material, the outer surface of the base is formed an outer film by means of vacuum plating or in-mold decoration; further comprises a semitransparent light cover corresponding to the light display area arranged between the decorative ring and the middle frame.

6. The washing machine door with a decorative ring according to claim 5, wherein the light cover is formed by means of glass atomization or glass frosted, or semitransparent plastic with a light transmittance in the range of 30% to 90%.

7. The washing machine door with a decorative ring according to claim 1, wherein the time display area of the base made of transparent material is embedded into the light display area made of transparent material integrally; the outer surface of the base is formed an outer film by means of vacuum plating or in-mold decoration.

8. The washing machine door with a decorative ring according to claim 1, wherein the decorative ring and the middle frame are assembled with the connection of hooks and holes or by melting.

9. A washing machine, wherein the washing machine comprises the washing machine door with a decorative ring according to claim 1.

10. A laundry method using the washing machine according to claim 9, during which a user could see the time display module and LED light as a power supply is on while could not see the time display module and the light strip as the power supply is off, comprising:

(a) powering the washing machine and selecting one of working modes; calculating overall working time automatically; wherein the time display module and the light strip are being controlled by the control device;

(b) pressing a start button; during washing process, the overall decorative ring is transparent and the time display module displays remaining working time, and the user also could see LED light without the LED beads from the light display module due to the fact that the light transmittance of the time display area is greater than that of the light display area;

(c) completing the laundry and turning off the power supply, wherein the decorative ring turns into opaque and the time display module and light strip are invisible.

* * * * *